United States Patent [19]

Scott et al.

[11] 4,342,894

[45] Aug. 3, 1982

[54] ELECTRICAL SWITCH CONSTRUCTION DIAPHRAGM SEAL THEREFOR AND METHODS OF MAKING THE SAME

[75] Inventors: Douglas R. Scott; Frank Payne, both of Knoxville, Tenn.

[73] Assignee: Robertshaw Controls Company, Richmond, Va.

[21] Appl. No.: 194,427

[22] Filed: Oct. 6, 1980

[51] Int. Cl.[3] ..... H01H 9/04; H01H 35/40

[52] U.S. Cl. ..... 200/304; 200/302; 200/83 B; 92/104

[58] Field of Search ..... 200/302, 83 R, 83 B, 200/81 R, 306, 304; 92/96, 104

[56] References Cited

U.S. PATENT DOCUMENTS

| | | | |
|---|---|---|---|
| 2,202,207 | 5/1940 | Johnson | 200/302 |
| 2,436,958 | 3/1948 | Eisenberg | 200/302 |
| 2,814,703 | 11/1957 | Martin | 200/302 |
| 3,028,467 | 4/1962 | Hubbell | 200/302 |
| 4,054,763 | 10/1977 | Wilcox | 200/83 R |
| 4,296,287 | 10/1981 | Boulanger et al. | 200/302 |

*Primary Examiner*—Willis Little

*Attorney, Agent, or Firm*—Candor, Candor & Tassone

[57] ABSTRACT

An electrical switch construction having a housing carrying an electrical switch and an actuator for actuating an operating plunger of the electrical switch, the construction having a flexible diaphragm seal disposed against the electrical switch to seal the same to a part of the housing and define a chamber with that part of the housing so that the electrical switch is sealed therein. The diaphragm seal has a portion thereof disposed between the plunger and the actuator. The diaphragm seal has means for preventing a pressure increase in the chamber thereof that would adversely act across the portion of the diaphragm seal when there is an increase in the volume of fluid in the chamber regardless of whether the increase in volume is caused by a change in temperature and/or an out gasing of the plastic parts of the switch.

46 Claims, 5 Drawing Figures

ELECTRICAL SWITCH CONSTRUCTION DIAPHRAGM SEAL THEREFOR AND METHODS OF MAKING THE SAME

BACKGROUND OF THE INVENTION

1. Field of the Invention

This invention relates to an improved electrical switch construction and method of making the same as well as to an improved diaphragm seal means for such an electrical switch construction or the like and method of making such a diaphragm seal means.

2. Prior Art Statement

It is known to provide an electrical switch construction having a housing means carrying an electrical switch means and an actuator means for actuating an operating plunger means of the electrical switch means, the construction having a flexible diaphragm seal means disposed against the electrical switch means to seal the same to a part of the housing means and define a chamber with that part of the housing means so that the switch means is sealed therein. Such prior known diaphragm seal means has a portion thereof that is disposed between the plunger means and the actuator means and is responsive to the pressure differential acting across that portion of the diaphragm seal means.

SUMMARY OF THE INVENTION

It is a feature of this invention to provide an improved electrical switch construction wherein a change in the pressure differential acting across the actuating portion of the diaphragm seal means thereof is substantially prevented.

In particular, it was found according to the teachings of this invention that when the prior known electrical switch construction had a diaphragm seal means sealing the electrical switch means to a part of the housing means in a manner to define a chamber with that part of the housing means so that the switch means is sealed therein, a change in the pressure differential acting across a portion of that diaphragm seal means that is disposed between the plunger means of the electrical switch means and an actuator means therefor adversely changed the accuracy of the operation of the electrical switch construction, such change in pressure differential being caused by an increase in the volume of the fluid in the switch chamber that results from an increase in the temperature of the fluid in the chamber of the switch construction and/or an out gasing of the plastic parts of the electrical switch means that is sealed in the chamber by such diaphragm seal means.

Accordingly, it was further found according to the teachings of this invention that the diaphragm seal means could be provided with means that would prevent a pressure increase in the chamber that seals the electrical switch means to the housing means when there is an increase in the volume of fluid in that chamber regardless of how the increase in the volume of fluid in the chamber is created.

In particular, one embodiment of this invention provides an electrical switch construction having a housing means carrying an electrical switch means and actuator means for actuating an operating plunger means of the electrical switch means, the construction having a flexible diaphragm seal means disposed against the electrical switch means to seal the same to a part of the housing means and define a chamber with that part of the housing means so that the switch means is sealed therein.

The diaphragm seal means has a portion thereof disposed between the plunger means and the actuator means. The diaphragm seal means has means for preventing a pressure increase in the chamber that would adversely act across the portion of the diaphragm seal means when there is an increase in the volume of the fluid in the chamber. The means of the diaphragm seal means for preventing the pressure increase comprises a readily expandable section of the diaphragm seal means that increases the volume of the chamber as the pressure therein tends to increase and thereby prevents such pressure increase at the portion of the diaphragm seal means. The part of the housing means has a substantially flat wall. The switch means comprises a casing disposed against the flat wall. The diaphragm seal means has a cup-shaped part for covering the switch casing and a substantially flat part for engaging against the flat wall outboard of the switch casing, the expandable section being disposed in the flat part of the diaphragm seal means.

Accordingly, it is an object of this invention to provide an improved electrical switch construction having one or more of the novel features of this invention as set forth above or hereinafter shown or described.

Another object of this invention is to provide a method of making such an electrical switch construction, the method of this invention having one or more of the novel features of this invention as set forth above or hereinafter shown or described.

Another object of this invention is to provide an improved diaphragm seal means for such an electrical switch construction or the like, the improved diaphragm seal means of this invention having one or more of the novel features of this invention as set forth above or hereinafter shown or described.

Another object of this invention is to provide a method of making such a diaphragm seal means, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
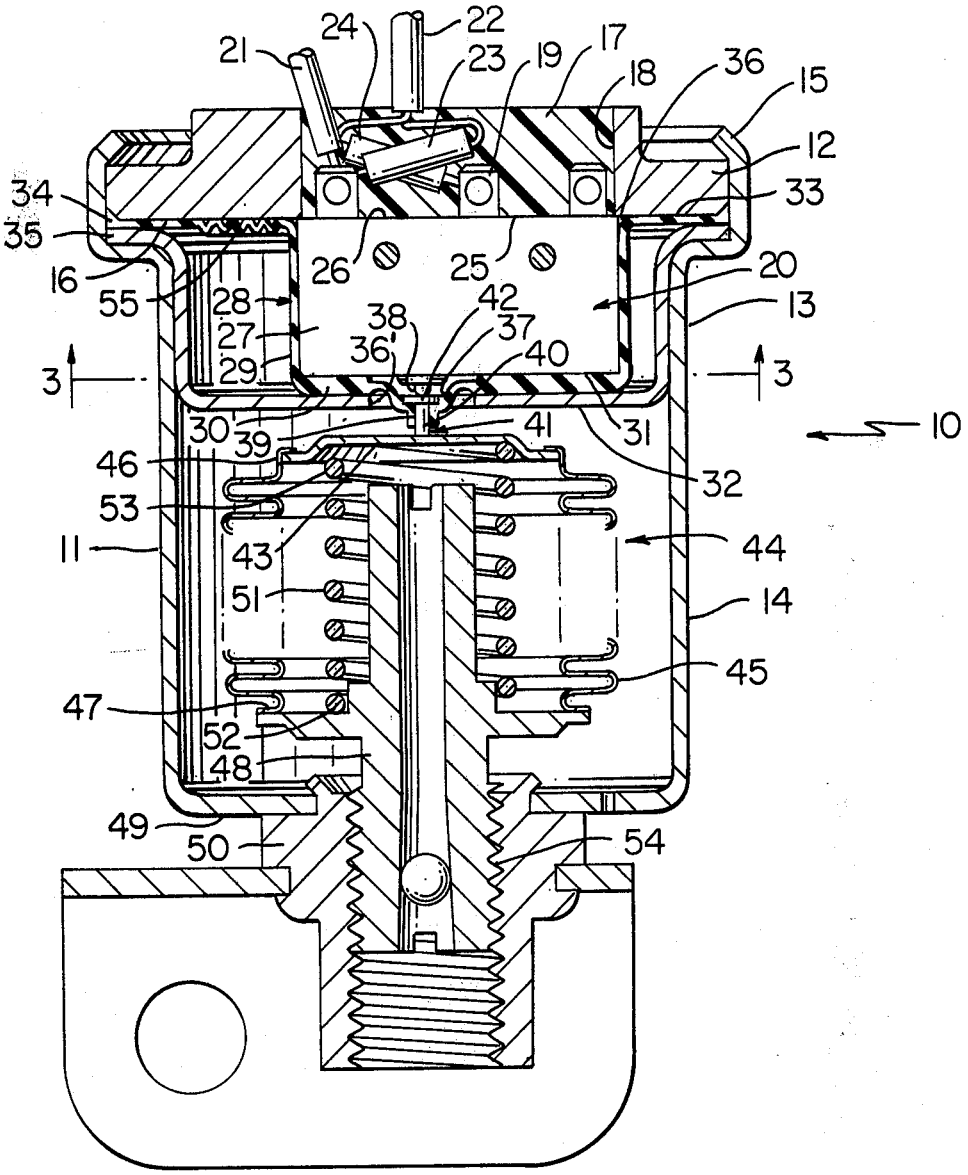
FIG. 1 is a cross-sectional view of the improved electrical switch construction of this invention.

While the various features of this invention are hereinafter described and illustrated as being particularly adapted to provide an electrical switch construction that is operated by a change in barometric pressure, it is to be understood that the various features of this invention can be utilized singly or in any combination thereof to provide an electrical switch construction that is operated by other types of actuators as desired.

Therefore, this invention is not to be limited to only the embodiment illustrated in the drawings, because the drawings are merely utilized to illustrate one of the wide variety of uses of this invention.

Referring now to FIG. 1, the improved electrical switch construction of this invention is generally indicated by the reference numeral 10 and comprises a housing means 11 formed from a plurality of housing parts 12, 13 and 14 suitably secured together, such as by having the end 15 of the cup-shaped housing member 14 turned over the housing part 12 with the housing part 13 being stacked therebetween.

The housing part 12 has a substantially flat wall 16 that is defined in part by an epoxy seal means 17 that fills an opening means 18 formed through the housing part 12 and in which a plurality of terminals 19 of an electrical switch means 20 extend to be interconnected to suitable external lead means 21 and 22 as well as to suitable electrical components 23 and 24 for any desired purposes, the epoxy seal means 17 sealing the inner ends of the leads 21 and 22, the electrical components 23 and 24 and the terminals 19 within the opening 18 of the housing part 12 so that the inner surface 25 of the epoxy seal 17 is substantially coplanar with the inner surface of the housing part 12 to define part of the flat wall means 16 against which a flat end 26 of a casing 27 of the electrical switch means 20 is disposed.

A flexible diaphragm seal means of this invention is generally indicated by the reference numeral 28 and has a cup-shaped portion 29 adapted to be disposed over the casing 27 of the electrical switch means 20 so that its closed end portion 30 can be disposed between the end 31 of the casing 27 and the closed end 32 of the cup-shaped housing member 13, the diaphragm seal means 28 having a substantially flat circular portion 33 disposed outboard of the cup-shaped portion 29 thereof and being adapted to be disposed against the flat surface 16 of the housing part 12 with its outer peripheral portion 34 being adapted to be crimped between the open end 35 of the cup-shaped housing member 13 and the surface 16 of the housing part 12 to completely seal the electrical switch means 20 within a chamber 36 defined between the diaphragm seal means 28 and the housing part 12 as illustrated in FIG. 1.

The closed end 32 of the cup-shaped housing member 13 has an opening 36' formed therethrough and through which a portion 37 of the closed end 30 of the cup-shaped part 29 of the diaphragm seal means 28 is adapted to move for the purpose of actuating the actuating plunger 38 of the electrical switch means 20 for operating the electrical switch means 20 for any suitable purpose.

In particular, the actuating portion 37 of the diaphragm seal means 28 has an opening 39 passing therethrough and receives part of the stem portion 40 of a metallic pin means 41 which has an enlarged head 42 engaging against the actuating plunger 38 and an end 42 of the stem 40 engaging against a movable wall or member 43 of a condition responsive actuator means that is generally indicated by the reference numeral 44 and is carried by the housing means 11.

The condition responsive actuator means 44 comprises a barometric pressure sensor that has a bellows construction 45 provided with one end 46 sealed to the movable member 43 while the other end 47 thereof is sealed to a retainer means 48 that is fastened to the cup-shaped housing member 14 at its closed end wall 49 by suitable fastening means 50 as illustrated.

A compression spring 51 is disposed within the bellows construction 45 and has one end 52 bearing against the retainer means 48 and the other end 53 thereof bearing against the movable wall 43 to thereby tend to move the movable wall 43 in a direction to cause the pin means 41 to operate the plunger means 38 of the electrical switch means 20.

In this manner, as the barometric pressure being sensed by the condition responsive means 44 changes, the bellows construction 45 either expands or contracts as the case may be and thereby when a certain barometric pressure is sensed by the actuator 44, the movable wall 43 will have been moved to such a position that the same has moved the pin means 41 to actuate the plunger means 38 of the electrical switch means 20 to cause the electrical switch means 20 to operate an electrical circuit (not shown) that is interconnected to the lead means 21 and 22 for any desired purpose.

Conversely, when the barometric pressure being sensed by the condition responsive means 44 changes from that predetermined condition so that the bellows construction 45 causes the plunger means 38 to move to another operating position thereof and thereby change the operating condition of the electrical switch means 20, the electrical circuit connected to the lead means 21 and 22 will be changed in a manner well known in the art.

Since the retainer 48 of the condition responsive means 44 is threaded into the fastening means 50 at a threaded connection 54 therebetween, the operation of the electrical switch construction 10 can be so callibrated that the electrical switch construction 10 will only operate when a certain predetermined barometric pressure is sensed by the device 44.

However, it has been found, according to the teachings of this invention, that the pressure differential acting across the portion 37 of the diaphragm seal means 49 in a direction to oppose upward movement of the movable wall 43 of the condition responsive means 44 in FIG. 1 can change the accuracy of the operation of the electrical switch construction 10 when that pressure differential increases because of a volume increase in the fluid in the chamber 36 that seals the electrical switch means 20 to the housing part 12.

For example, it has been found that an increase in the temperature of the fluid or air in the chamber 36 increases the volume of that air in the chamber 36 so that a pressure increase would operate across the portion 37 of the diaphragm seal means 28 in a direction to oppose upward movement of the movable wall 43 of the condition responsive means 44. Similarly, an increase of the volume of the air in the chamber 36 caused by an out gasing of the plastic parts of the switch means 20 will cause an adverse increase in the pressure differential acting across the diaphragm portion 37 of the diaphragm means 28 in a direction to oppose upward movement of the movable wall 43 of the condition responsive means 44.

However, as previously stated, it is a feature of this invention to prevent the aforementioned adverse change in pressure differential acting across the actuating portion 37 of the diaphragm seal means 38 of this invention and this feature is accomplished by providing a readily expandable portion 55 in the diaphragm seal means 28 of this invention which will take up any volume increase in the fluid in the chamber 37 of the switch construction of the electrical switch construction 10 that is caused by an increase in temperature thereof and/or by an out gasing of the plastic parts of the electrical switch means 20 as the case may be.

Figure 4:
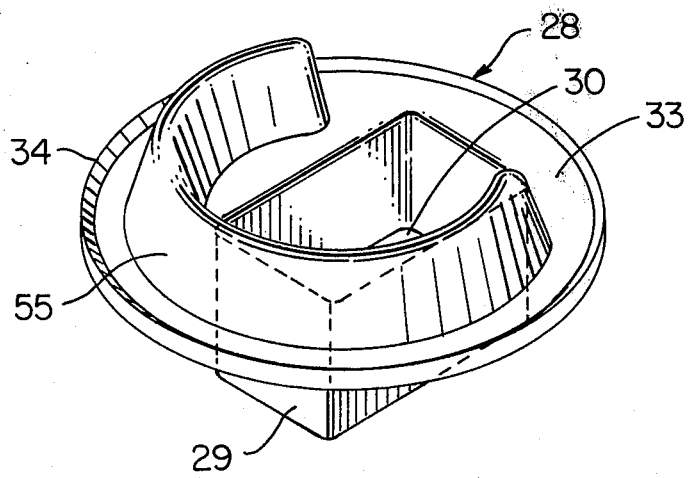
FIG. 4 is a perspective view of the improved diaphragm seal means of this invention that is utilized in the electrical switch construction of FIG. 1.
Figure 5:
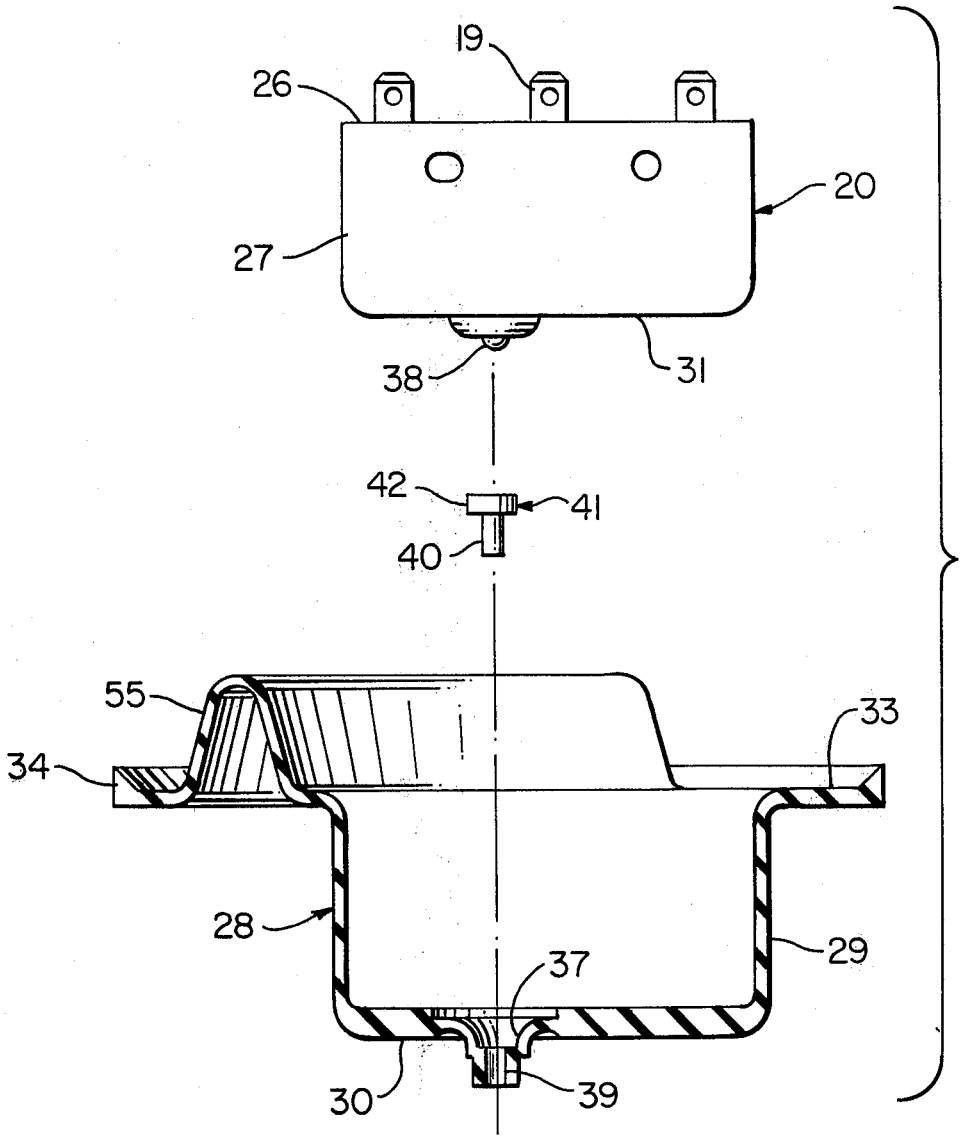
FIG. 5 is an exploded view of certain parts of the electrical switch construction of FIG. 1 and illustrates the diaphragm seal means in cross section.

In particular, when the diaphragm seal means 28 of this invention is initially molded from any suitable material, such as elastomeric material, the readily expandable portion 55 thereof is formed as a C-shaped single convolution as illustrated in FIGS. 4 and 5 that substantially surrounds the cup-shaped portion 29 thereof and has a normal bias to be a single convolution that extends from the flat circular portion 33 thereof in a direction opposite to the direction of the cup-shaped portion 29.

In this manner, when the diaphragm seal means 28 of this invention is initially disposed over the casing 27 of the switch means 20 so as to have the flat portion 33 thereof engaging against the wall 16 of the housing part 12 as illustrated in FIG. 1, the portion 55 of the diaphragm seal means 28 folds into a plurality of folds against the wall 16 of the housing part 12 to tend to remain in the position illustrated in FIG. 1 and thereby initially provide a small volume for the chamber 36 that contains the electrical switch means 20.

However, as the volume of the air trapped in the chamber 36 increases through the aforementioned temperature change or out gasing, the expandable section 55 is adapted to move outwardly from the wall 16 to progressively increase the volume of the chamber 36 and thereby prevent the increase in volume from providing an increase in pressure differential acting across the actuating portion 37 of the diaphragm seal means 28. Thus, the increase in volume of the air in the chamber 36 does not increase the pressure differential acting across the actuating portion 37 of the diaphragm means 28 so that the accuracy of the operation of the electrical switch construction 10 remains substantially constant.

Figure 2:
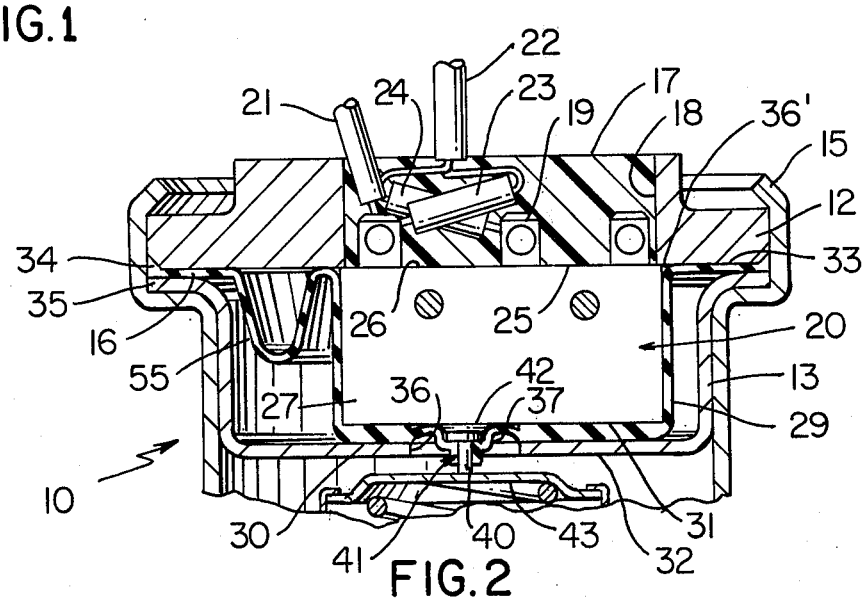
FIG. 2 is a fragmentary view similar to FIG. 1 and illustrates the electrical switch construction of this invention in another operating condition thereof.
Figure 3:
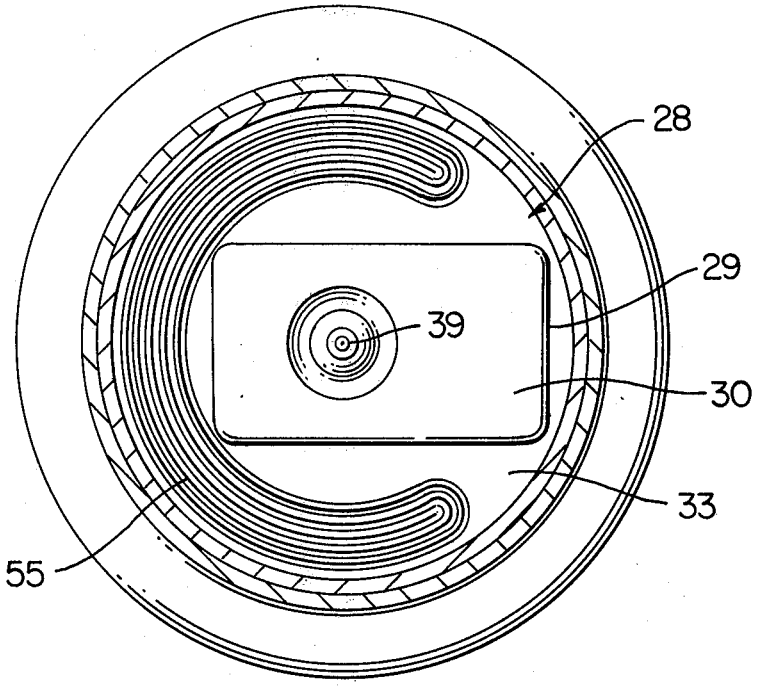
FIG. 3 is a cross-sectional view taken on line 3—3 of FIG. 1.

As illustrated in FIG. 2, the expandable portion 55 has been shown in its fully expanded condition to provide a single convolution extending away from the wall 16 of the housing part 12. However, it is to be understood that the expandable portion 55 will only expand away from the wall 16 an amount that is sufficient to take up the particular volume increase of the air in the chamber 36.

Upon a subsequent decrease in temperature of the electrical switch construction 10 of this invention, the volume of the air in the chamber 36 will decrease and the foldable section 55 will collapse toward the wall 16 of the housing part 12 to thereby correspondingly decrease the volume in the chamber 36 so that the pressure differential across the portion 37 of the diaphragm seal means 28 still remains substantially constant whereby the condition responsive means 44 will accurately control the electrical switch means 20 in a manner not provided by prior known diaphragm sealed switch means or the like.

Therefore, it can be seen that the electrical switch construction 10 of this invention, as well as the diaphragm seal means 28 therefor, can be formed in a relatively simple manner by the methods of this invention to operate in a manner now to be described.

After the diaphragm seal means 28 of this invention has sealed the electrical switch means 20 to the housing part 12 in the manner illustrated in FIG. 1, it can be seen that as the barometric pressure being sensed by the condition responsive means 44 changes in a manner to cause the movable wall 43 of the bellows construction 45 to move upwardly in FIG. 1, the movable wall 43 acts on the end 42 of the pin means 41 to move the same upwardly therewith and progressively move the plunger 38 inwardly into the casing 27 so that a certain position of the plunger means 38 in its in condition will cause the electrical switch means 20 to operate and thereby change the electrical circuit being interconnected thereto by the external leads 21 and 22 for any desired purpose. Conversely, as the barometric pressure being sensed by the condition responsive means 44 changes in a manner so that the movable wall 43 moves downwardly from the position illustrated in FIG. 2, the internal spring means (not shown) of the switch means 20 for the plunger means 38 of the switch means 20 will move the pin means 41 downwardly therewith to thereby cause the electrical switch means 20 to operate to its other condition thereof and thereby again change the condition of the electrical circuit connected to the lead means 21 and 22 for any desired purpose.

Thus, during the operation of the electrical switch construction 10 of this invention, the diaphragm portion 37 of the diaphragm seal means 28 will move upwardly and downwardly in the manner illustrated in FIGS. 1 and 2 to operate the electrical switch means 20.

If during such operation of the electrical switch means 20 of the electrical switch construction 10 of this invention, an increase in the volume of the air within the sealed chamber 36 should occur, such as through an increase in the temperature thereof and/or through an out gasing of the plastic parts of the switch means 20, the expandable section 55 of the diaphragm seal means 28 will move away from the wall 16 of the housing part 12 to increase the volume of the chamber 36 and thereby permit the air to expand therein so that a change in the pressure differential acting across the actuating portion 37 of the diaphragm seal means 28 will not occur.

Conversely, should the volume of the air in the chamber 36 substantially decrease from the increased volume condition thereof, the expandable section 55 will move back toward the wall 16 of the housing part 12 to decrease the volume of the chamber 36 to correspond to the change in the volume of the air therein so that an adverse pressure differential effect acting across the diaphragm portion 37 of the diaphragm seal means 28 will not take place.

Therefore, it can be seen that this invention not only provides an improved electrical switch construction and method of making the same, but also this invention provides an improved diaphragm seal means therefor as well as a method of making the same.

While the forms and methods of this invention now preferred have been illustrated and described as required by the Patent Statute, it is to be understood that other forms and method steps can be utilized and still fall within the scope of the appended claims.

What is claimed is:

1. In an electrical switch construction having a housing means carrying an electrical switch means and an actuator means for actuating an operating plunger means of said electrical switch means, said construction having a flexible diaphragm seal means disposed against said electrical switch means to seal the same to a part of said housing means and define a chamber with said part of said housing means that has said switch means sealed therein, said diaphragm seal means having a portion thereof disposed between said plunger means and said actuator means, the improvement wherein said diaphragm seal means has means for preventing a pressure increase in said chamber that could adversely act across said portion of said diaphragm seal means when there is an increase in the volume of fluid in said chamber, said means of said diaphragm seal means for preventing said pressure increase comprising a readily expandable section of said diaphragm seal means that increases the volume of said chamber as the pressure therein tends to increase and thereby prevents such pressure increase at said portion of said diaphragm seal means, said part of said housing means having a substantially flat wall, said switch means comprising a casing disposed against said flat wall, said diaphragm seal means having a cup-shaped part for covering said switch casing and a substantially flat part for engaging against said flat wall outboard of said switch casing, said expandable section being disposed in said flat part of said diaphragm seal means.

2. An electrical switch construction as set forth in claim 1 wherein said actuator means comprises a condition responsive means.

3. An electrical switch construction as set forth in claim 2 wherein said condition responsive means is responsive to barometric pressure.

4. An electrical switch construction as set forth in claim 1 wherein said actuator means has an axially movable member that is axially aligned with said plunger means.

5. An electrical switch construction as set forth in claim 4 wherein said portion of said diaphragm seal means carries a motion transmitting pin that has opposed ends, one of said ends of said pin engaging said plunger means and the other of said ends thereof engaging said movable member.

6. An electrical switch construction as set forth in claim 5 wherein said one end of said pin comprises an enlarged head, said pin having the remainder thereof comprising a rod means extending from said enlarged head, said portion of said diaphragm seal means having an opening passing therethrough and receiving part of said rod means of said pin therein.

7. An electrical switch construction as set forth in claim 1 wherein said expandable section of said diaphragm seal means is offset relative to said portion of said diaphragm seal means.

8. An electrical switch construction as set forth in claim 7 wherein said expandable section of said diaphragm seal means is adapted to fold into a bellows-like arrangement when in its non-fully expanded condition.

9. An electrical switch construction as set forth in claim 8 wherein said expandable section is substantially C-chaped.

10. An electrical switch construction as set forth in claim 9 wherein said C-shaped expandable section partially surrounds said switch means.

11. In an electrical switch construction having a housing means carrying an electrical switch means and an actuator means for actuating an operating plunger means of said electrical switch means, said construction having a flexible diaphragm seal means disposed against said electrical switch means to seal the same to a part of said housing means and define a chamber with said part of said housing means that has said switch means sealed therein, said diaphragm seal means having a portion thereof disposed between said plunger means and said actuator means, the improvement wherein said diaphragm seal means has means for preventing a pressure increase in said chamber that could adversely act across said portion of said diaphragm seal means when there is an increase in the volume of fluid in said chamber, said means of said diaphragm seal means for preventing said pressure increase comprising a readily expandable section of said diaphragm seal means that increases the volume of said chamber as the pressure therein tends to increase and thereby prevents such pressure increase at said portion of said diaphragm seal means, said expandable section of said diaphragm seal means being offset relative to said portion of said diaphragm seal means, said expandable section of said diaphragm seal means being adapted to fold into a bellows-like arrangement when in its non-fully expanded condition, said expandable section being substantially C-shaped, said C-shaped expandable section partially surrounding said switch means, said part of said housing means having a substantially flat wall, said switch means comprising a casing disposed against said flat wall, said diaphragm seal means having a cup-shaped part for covering said switch casing and a substantially flat part for engaging against said flat wall outboard of said switch casing, said expandable section being disposed in said flat part of said diaphragm seal means.

12. An electrical switch construction as set forth in claim 11 wherein said expandable section has a normal bias to expand in a direction toward said flat wall whereby said expandable section has a normal tendency to fold into its bellows-like arrangement against said flat wall.

13. An electrical switch construction as set forth in claim 12 wherein said expandable section is adapted to expand into a single convolution-like shape away from said flat wall.

14. An electrical switch construction as set forth in claim 11 wherein said diaphragm seal means has an outer peripheral part sealed to said flat wall by said housing means.

15. In a method of making an electrical switch construction having a housing means carrying an electrical switch means and an actuator means for actuating an operating plunger means of said electrical switch means, said construction having a flexible diaphragm seal means disposed against said electrical switch means to seal the same to a part of said housing means and define a chamber with said part of said housing means that has said switch means sealed therein, said diaphragm seal means having a portion thereof disposed between said plunger means and said actuator means, the improvement comprising the steps of forming said diaphragm seal means with means for preventing a pressure increase in said chamber that could adversely act across said portion of said diaphragm seal means when there is an increase in the volume of fluid in said chamber, forming said means of said diaphragm seal means for preventing said pressure increase to comprise a readily expandable section of said diaphragm seal means that increases the volume of said chamber as the pressure therein tends to increase and thereby prevent such pressure increase at said portion of said diaphragm seal means, forming said part of said housing means to have a substantially flat wall, disposing the casing of said switch means against said flat wall, forming said diaphragm seal means to have a cup-shaped part for covering said switch casing and a substantially flat part for engaging against said flat wall outboard of said switch casing, and forming said expandable section in said flat part of said diaphragm seal means.

16. A method of making an electrical switch construction as set forth in claim 15 and including the step of forming said actuator means from a condition responsive means.

17. A method of making an electrical switch construction as set forth in claim 15 and including the step of forming said condition responsive means to be responsive to barometric pressure.

18. A method of making an electrical switch construction as set forth in claim 15 and including the step of forming said actuator means to have an axially movable member that is axially aligned with said plunger means.

19. A method of making an electrical switch construction as set forth in claim 18 and including the steps of forming said portion of said diaphragm seal means to carry a motion transmitting pin that has opposed ends, and disposing one of said ends of said pin to engage said plunger means and the other of said ends thereof to engage said movable member.

20. A method of making an electrical switch construction as set forth in claim 19 and including the steps of forming said one end of said pin to comprise an enlarged head, forming said pin to have the remainder thereof comprising a rod means extending from said enlarged head, forming said portion of said diaphragm seal means to have an opening passing therethrough, and disposing part of said rod means of said pin in said opening.

21. A method of making an electrical switch construction as set forth in claim 15 and including the step of forming said expandable section of said diaphragm seal means to be in offset relation to said portion of said diaphragm seal means.

22. A method of making an electrical switch construction as set forth in claim 21 and including the step of forming said expandable section of said diaphragm seal means to be adapted to fold into a bellows-like arrangement when in its non-fully expanded condition.

23. A method of making an electrical siwtch construction as set forth in claim 22 and including the step of forming said expandable section to be substantially C-shaped.

24. A method of making an electrical switch construction as set forth in claim 23 and including the step of forming said C-shaped expandable section to partially surround said switch means.

25. In a method of making an electrical switch construction having a housing means carrying an electrical switch means and an actuator means for actuating an operating plunger means of said electrical switch means, said construction having a flexible diaphragm seal means disposed against said electrical switch means to seal the same to a part of said housing means and define a chamber with said part of said housing means that has said switch means sealed therein, said diaphragm seal means having a portion thereof disposed between said plunger means and said actuator means, the improvement comprising the steps of forming said diaphragm seal means with means for preventing a pressure increase in said chamber that could adversely act across said portion of said diaphragm seal means when there is an increase in the volume of fluid in said chamber, forming said means of said diaphragm seal means for preventing said pressure increase to comprise a readily expandable section of said diaphragm seal means that increases the volume of said chamber as the pressure therein tends to increase and thereby prevent such pressure increase at said portion of said diaphragm seal means, forming said expandable section of said diaphragm seal means to be in offset relation to said portion of said diaphragm seal means, forming said expandable section of said diaphragm seal means to be adapted to fold into a bellows-like arrangement when in its non-fully expanded condition, forming said expandable section to be substantially C-shaped, forming said C-shaped expandable section to partially surround said switch means, forming said part of said housing means to have a substantially flat wall, disposing the casing of said switch means against said flat wall, forming said diaphragm seal means to have a cup-shaped part for covering said switch casing and a substantially flat part for engaging against said flat wall outboard of said switch casing, and forming said expandable section in said flat part of said diaphragm seal means.

26. A method of making an electrical switch construction as set forth in claim 25 and including the step of forming said expandable section to have a normal bias to expand in a direction toward said flat wall whereby said expandable section has a normal tendency to fold into its bellows-like arrangement against said flat wall.

27. A method of making an electrical switch construction as set forth in claim 26 and including the step of forming said expandable section to be adapted to expand into a single convolution-like shape away from said flat wall.

28. A method of making an electrical switch construction as set forth in claim 25 and including the step of forming said diaphragm seal means to have an outer peripheral part sealed to said flat wall by said housing means.

29. In a diaphragm seal means for an electrical switch construction having a housing means carrying an electrical switch means and an actuator means for actuating an operating plunger means of said electrical switch means, said flexible diaphragm seal means being adapted to be disposed against said electrical switch means to seal the same to a part of said housing means and define a chamber with said part of said housing means that has said switch means sealed therein, said diaphragm seal means having a portion thereof adapted to be disposed between said plunger means and said actuator means, the improvement wherein said diaphragm seal means has means adapted for preventing a pressure increase in said chamber that would adversely act across said portion of said diaphragm seal means when there is an increase in the volume of fluid in said chamber, said means of said diaphragm seal means for preventing said pressure increase comprising a readily expandable section of said diaphragm seal means that is adapted to increase the volume of said chamber as the pressure therein tends to increase and thereby prevent such pressure increase at said portion of said diaphragm seal means, said part of said housing means having a substantially flat wall and said switch means comprising a casing disposed against said flat wall, said diaphragm seal means being a cup-shaped part adapted for covering said switch casing and a substantially flat part adapted for engaging against said flat wall outboard of said switch casing, said expandable section being disposed in said flat part of said diaphragm seal means.

30. A diaphragm seal means for an electrical switch construction as set forth in claim 29 wherein said expandable section of said diaphragm seal means is offset relative to said portion of said diaphragm seal means.

31. A diaphragm seal means for an electrical switch construction as set forth in claim 30 wherein said expandable section of said diaphragm seal means is adapted to fold into a bellows-like arrangement when in its non-fully expanded condition.

32. A diaphragm seal means for an electrical switch construction as set forth in claim 31 wherein said expandable section is substantially C-shaped.

33. A diaphragm seal means for an electrical switch construction as set forth in claim 32 wherein said C-shaped expandable section is adapted to partially surround said switch means.

34. In a diaphragm seal means for an electrical switch construction having a housing means carrying an electrical switch means and an actuator means for actuating an operating plunger means of said electrical switch means, said flexible diaphragm seal means being adapted to be disposed against said electrical switch means to seal the same to a part of said housing means and define a chamber with said part of said housing means that has said switch means sealed therein, said diaphragm seal means having a portion thereof adapted to be disposed between said plunger means and said actuator means, the improvement wherein said diaphragm seal means has means adapted for preventing a pressure increase in said chamber that would adversely act across said portion of said diaphragm seal means when there is an increase in the volume of fluid in said chamber, said means of said diaphragm seal means for preventing said pressure increase comprising a readily expandable section of said diaphragm seal means that is adapted to increase the volume of said chamber as the pressure therein tends to increase and thereby prevent such pressure increase at said portion of said diaphragm seal means, said expandable section of said diaphragm seal means being offset relative to said portion of said diaphragm seal means, said expandable section of said diaphragm seal means being adapted to fold into a bellows-like arrangement when in its non-fully expanded condition, said expandable section being substantially C-shaped, said C-shaped expandable section being adapted to partially surround said switch means, said part of said housing means having a substantially flat wall and said switch means comprises a casing disposed against said flat wall, said diaphragm seal means having a cup-shaped part adapted for covering said switch casing and a substantially flat part adapted for engaging against said flat wall outboard of said switch casing, said expandable section being disposed in said flat part of said diaphragm seal means.

35. A diaphragm seal means for an electrical switch construction as set forth in claim 34 wherein said expandable section has a normal bias to be adapted to expand in a direction toward said flat wall whereby said expandable section has a normal tendency to fold into its bellows-like arrangement against said flat wall.

36. A diaphragm seal means for an electrical switch construction as set forth in claim 35 wherein said expandable section is adapted to expand into a single convolution-like shape away from said flat wall.

37. A diaphragm seal means for an electrical switch construction as set forth in claim 34 wherein said diaphragm seal means has an outer peripheral part adapted to be sealed to said flat wall by said housing means.

38. In a method of making a diaphragm seal means for an electrical switch construction having a housing means carrying an electrical switch means and an actuator means for actuating an operating plunger means of said electrical switch means, said diaphragm seal means being adapted to be disposed against said electrical switch means to seal the same to a part of said housing means and define a chamber with said part of said housing means that has said switch means sealed therein, said diaphragm seal means having a portion thereof adapted to be disposed between said plunger means and said actuator means, the improvement comprising the steps of forming said diaphragm seal means with means adapted for preventing a pressure increase in said chamber that would adversely act across said portion of said diaphragm seal means when there is an increase in the volume of fluid in said chamber, forming said means of said diaphragm seal means for preventing said pressure increase to comprise a readily expandable section of said diaphragm seal means that is adapted to increase the volume of said chamber as the pressure therein tends to increase and thereby prevent such pressure increase at said portion of said diaphragm seal means, forming said diaphragm seal means to have a cup-shaped part adapted for covering a switch casing of said switch means and a substantially flat part adapted for engaging against a flat wall of said housing means outboard of said switch casing, and forming said expandable section in said flat part of said diaphragm seal means.

39. A method of making a diaphragm seal means for an electrical switch construction as set forth in claim 38 and including the step of forming said expandable section of said diaphragm seal means to be in offset relation to said portion of said diaphragm seal means.

40. A method of making a diaphragm seal means for an electrical switch construction as set forth in claim 39 and including the step of forming said expandable section of said diaphragm seal means to be adapted to fold into a bellows-like arrangement when in its non-fully expanded condition.

41. A method of making a diaphragm seal means for an electrical switch construction as set forth in claim 40 and including the step of forming said expandable section to be substantially C-shaped.

42. A method of making a diaphragm seal means for an electrical switch construction as set forth in claim 41 and including the step of forming said C-shaped expandable section to be adapted to partially surround said switch means.

43. In a method of making a diaphragm seal means for an electrical switch construction having a housing means carrying an electrical switch means and an actuator means for actuating an operating plunger means of said electrical switch means, said diaphragm seal means being adapted to be disposed against said electrical switch means to seal the same to a part of said housing means and define a chamber with said part of said housing means that has said switch means sealed therein, said diaphragm seal means having a portion thereof adapted to be disposed between said plunger means and said actuator means, the improvement comprising the steps of forming said diaphragm seal means with means adapted for preventing a pressure increase in said chamber that would adversely act across said portion of said diaphragm seal means when there is an increase in the volume of fluid in said chamber, forming said means of said diaphragm seal means for preventing said pressure increase to comprise a readily expandable section of said diaphragm seal means that is adapted to increase the volume of said chamber as the pressure therein tends to increase and thereby prevent such pressure increase at said portion of said diaphragm seal means, forming said expandable section of said diaphragm seal means to be in offset relation to said portion of said diaphragm seal means, forming said expandable section of said diaphragm seal means to be adapted to fold into a bellows-like arrangement when in its non-fully expanded condition, forming said expandable section to be substantially C-shaped, forming said C-shaped expandable section to be adapted to partially surround said switch means, forming said diaphragm seal means to have a cup-shaped part adapted for covering a switch casing of said switch means and a substantially flat part adapted for engaging against a flat wall of said housing means outboard of said switch casing, and forming said expandable section in said flat part of said diaphragm seal means.

44. A method of making a diaphragm seal means for an electrical switch construction as set forth in claim 43 and including the step of forming said expandable section to have a normal bias to be adapted to expand in a direction toward said flat wall whereby said expandable section has a normal tendency to fold into its bellows-like arrangement against said flat wall.

45. A method of making a diaphragm seal means for an electrical switch construction as set forth in claim 44 and including the step of forming said expandable section to be adapted to expand into a single convolution-like shape away from said flat wall.

46. A method of making a diaphragm seal means for an electrical switch construction as set forth in claim 43 and including the step of forming said diaphragm seal means to have an outer peripheral part adapted to be sealed to said flat wall by said housing means.

* * * * *

UNITED STATES PATENT AND TRADEMARK OFFICE

CERTIFICATE OF CORRECTION

PATENT NO. : 4,342,894

DATED : August 3, 1982

INVENTOR(S) : Douglas R. Scott et al

It is certified that error appears in the above—identified patent and that said Letters Patent is hereby corrected as shown below:

Column 9, line 6, change "15" to --16--.

Signed and Sealed this

*Fifth* Day of *October 1982*

[SEAL]

*Attest:*

GERALD J. MOSSINGHOFF

*Attesting Officer*

*Commissioner of Patents and Trademarks*